US007784727B1

(12) United States Patent
Liao

(10) Patent No.: US 7,784,727 B1
(45) Date of Patent: Aug. 31, 2010

(54) CABLE REEL MECHANISM

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 12/453,282

(22) Filed: May 6, 2009

(51) Int. Cl.
*B65H 75/48* (2006.01)

(52) U.S. Cl. ..... 242/378.1; 242/385.1; 242/385.2

(58) Field of Classification Search ..... 242/378, 242/378.1–378.5, 385, 385.1–385.4; 33/767; 188/31, 69, 82.8, 82.84, 82.7, 82.74, 82.77, 188/82.1
See application file for complete search history.

(56) References Cited

U.S. PATENT DOCUMENTS 6,736,346 B1 * 5/2004 Park ..... 242/378.1
6,871,812 B1 * 3/2005 Chang ..... 242/378.1
7,364,109 B2 * 4/2008 Kuo ..... 242/373
7,523,883 B2 * 4/2009 Cheng ..... 242/378
2006/0261203 A1 * 11/2006 Yang ..... 242/378.4
2007/0295850 A1 * 12/2007 Lin ..... 242/378.1

* cited by examiner

*Primary Examiner*—John Q Nguyen
*Assistant Examiner*—Juan J Campos
(74) *Attorney, Agent, or Firm*—Rosenberg, Klein & Lee

(57) ABSTRACT

A cable reel mechanism includes a main body, a cable reel, a cable, a volute spring and a switching element. The main body has a receiving room defined therein and a limiting groove. The cable reel is turnably disposed in the receiving room of the main body and has a track groove in which a ball bearing is disposed. One portion of the ball bearing engages with the limiting groove of the main body. The cable is reeled on the cable reel. The switching element is disposed on the main body and has a pressing portion which detachably presses the ball bearing. The cable reel mechanism can be switched to different operation modes via the switching element, so that users can pull then retract the cable rapidly and directly to adjust the length of the cable, therefore the operation is easier and more convenient.

13 Claims, 14 Drawing Sheets

CABLE REEL MECHANISM

BACKGROUND OF THE INVENTION

1. Field of the Invention

The present invention relates to a cable reel mechanism, and more particularly to a cable reel mechanism which can be switched to different operation modes according to demands.

2. Description of Related Art

At present, communication devices, such as computers, modems, telephones, facsimile machines and so on must be connected via proper cables to achieve communication. In order to prevent the cables being too long or too short, various cable reel mechanisms for various communication devices has been developed. Generally, most of the cable reel mechanisms each include a main body, a cable, a cable reel, and a volute spring, so that plugs of the cables can be inserted in sockets of related communication devices, thereby communicating downloaded information and adjusting the length of the cables according to actual demands.

Additionally, the cable reel of each cable reel mechanism further has a track groove in which a ball bearing is disposed. The main body has a limiting groove formed therein. One portion of the ball bearing engages with the limiting groove and the ball bearing can only move in the limiting groove. Based on the special engagement of the ball bearing and the track groove, the cable can be pulled then retracted repeatedly so as to become fixed or movable.

Additionally, a kind of USB transmission line with a cable reel mechanism can achieve an effect such that when its cable being pulled then retracted repeatedly, then the cable may be become alternatively fixed or movable; wherein the effect is achieved according to special engagements of a ball bearing and a groove, along with a guiding groove and an arc-shaped groove, so users won't be affected by the reel tension force and can pull the needed fixed length of the cable easily.

The conventional cable reel mechanisms described above only have a single operation mode, that is, when the length of cables needs to be adjusted, it can only be achieved via repeatedly pulling then retracting which is very difficult for operation, furthermore the length of cables cannot be adjusted rapidly and directly, which causes inconvenient in use.

Hence, the inventors of the present invention believe that the shortcomings described above are able to be improved and finally suggest the present invention which is of a reasonable design and is an effective improvement based on deep research and thought.

SUMMARY OF THE INVENTION

A main object of the present invention is to provide a cable reel mechanism which can be switched to different operation modes so that users can pull then retract a cable rapidly and directly so as to adjust the length of the cable, thereby the operation can be achieved easier and more convenient.

To achieve the above-mentioned object, a cable reel mechanism in accordance with the present invention is provided. The cable reel mechanism at least includes: a main body, having a receiving room defined therein and a limiting groove; a cable reel which is turnably disposed in the receiving room of the main body and has a track groove in which a ball bearing is disposed, one portion of the ball bearing engaging with the limiting groove of the main body; a cable, reeled on the cable reel; a volute spring that is connected between the cable reel and the main body; and a switching element, disposed on the main body and having a pressing portion which detachably presses the ball bearing.

The efficacy of the present invention is as follows: the present invention can be switched to different operation modes via the switching element: when users push the switching element so that the pressing portion is detached from the ball bearing, the ball bearing and the track groove have no engagement established there-between, and the cable reel is in the free-rotation state, thereby users can pull then retract the cable rapidly and directly to adjust the length of the cable, accordingly, the cable need not be adjusted via repeatedly pulling and retracting, and the operation is thereby easier and more convenient.

The present invention further extends the switching element to form a blocking portion and disposes the corresponding stopping portions on the cable reel, thereby able to be switched to three different kinds of operation modes via the switching element. When users push the switching element to move towards the stopping portion, the blocking portion of the switching element can be fastened on the stopping portion of the cable reel so as to stop the cable reel, therefore the cable can be fixed and users can choose the optimum operation mode according to different applications, thereby the present invention is convenient for use.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 1:
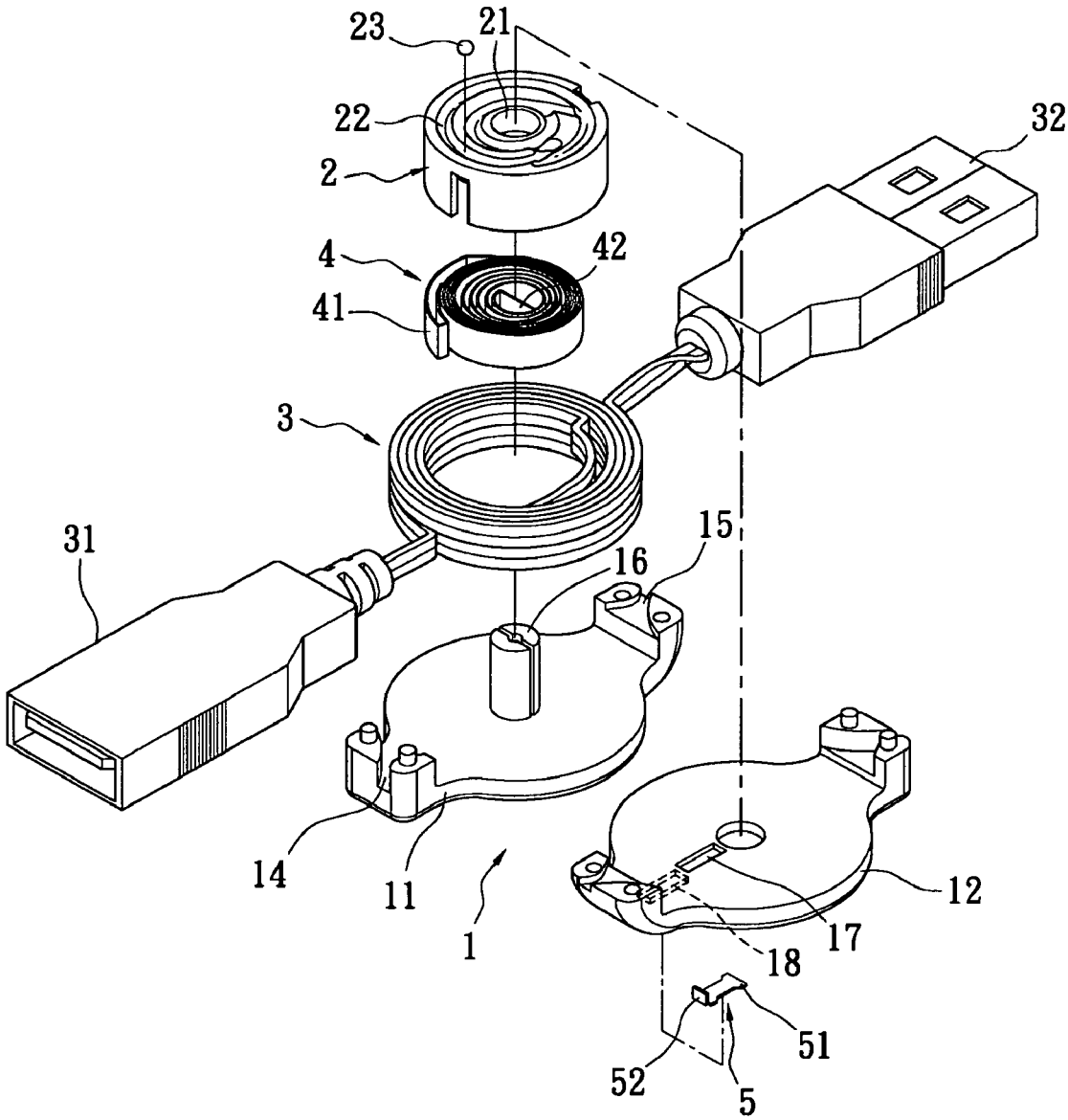
FIG. 1 is an exploded perspective view of a first embodiment of the present invention.

Please refer to FIGS. 1-4 illustrating a cable reel mechanism according to a first embodiment of the present invention. The cable reel mechanism at least includes a main body 1, a cable reel 2, a cable 3, a volute spring 4, and a switching element 5. The main body 1 includes a first shell 11 and a second shell 12 which may be combined together to form one part, wherein the one part is the main body 1 that is hollow, furthermore the combining of the first shell 11 and the second shell 12 is via tightening screws or fastening. The main body 1 has a receiving room 13 defined therein for receiving the cable reel 2, the cable 3, and the volute spring 4. The main body 1 further has a first cable hole 14 and a second cable hole 15 formed at the side edges thereof, and two ends of the cable 3 may extend through the first cable hole 14 and the second cable hole 15. A protruding shaft 16 is disposed on an inner wall of the main body 1 and extends into the receiving room 13. A limiting groove 17, which is a straight groove, is defined in the inner wall of the main body 1. A sliding groove 18 is formed in an outer wall of the main body 1 and is connected with the limiting groove 17, and the sliding groove 18 may also be a straight groove.

The cable reel 2 is received in the receiving room 13 of the main body 1 and has a shaft hole 21 in the center of the cable reel 2. The cable reel 2 is pivotedly disposed on the protruding shaft 16 of the main body 1 based on the shaft hole 21 so that the cable reel 2 may turn in the receiving room 13. The cable reel 2 has a track groove 22 in one face thereof and a ball bearing 23 is disposed in the track groove 22. One portion of the ball bearing 23 engages with the limiting groove 17 of the main body 1 so that the ball bearing 23 can only move in the limiting groove 17. Based on the special engagement of the ball bearing 23 and the track groove 22, the cable 3 can be repeatedly pulled then retracted so that the cable can become fixed or movable, thereby preventing the cable 3 from being affected by the reel tension force resulting from the volute spring 4, which would have troubled users when the cable 3 is drawn out. A receiving groove 24 is formed in the other face of the cable reel 2 and the receiving groove 24 is concave for a proper depth so as to receive the volute spring 4.

The cable 3 may be any wire material. The cable 3 may have a conductor disposed therein for power or signal transmission. Also, the cable 3 may have no conductor, and can be used as a general wire material. In the embodiment, the cable 3 is used as a communication cable, which has a conductor disposed therein. Two ends of the cable are respectively connected with electrical connectors 31, 32 which may be various electrical connectors, such as USB connectors, IEEE1394 connectors, HDMI connectors, RJ45 connectors, RJ11 connectors, AV terminals, DC terminals and so on, and may be female or male connectors, and alternatively, may be replaced by earphones etc. The cable 3 is reeled on the outer edge of the cable reel 2, the two ends of the cable 3 respectively extending out of the first cable hole 14 and the second cable hole 15 of the main body 1.

The volute spring 4 is disposed in the main body 1 and in the receiving groove 24 of the cable reel 2. A first fastening end 41 and a second fastening end 42 are respectively formed on two ends of the volute spring 4 and respectively fastened in the cable reel 2 and the protruding shaft 16 of the main body 1, so that the volute spring 4 is connected between the cable reel 2 and the main body 1 and can store kinetic energy when the cable reel 2 turns.

The switching element 5 is disposed on the main body 1. In the present embodiment, the switching element 5 is a sliding block which is slidably disposed in the sliding groove 18 of the main body 1. The switching element 5 has a pressing portion 51 and a pushing portion 52, wherein the pressing portion 51 may extend into the limiting groove 17 in the inner wall of the main body 1 and the pushing portion 52 is connected with one end of the pressing portion 51. The pushing portion 52 extends out of the main body 1 so as to be used to push the switching element 5 to move along a lengthways straight line for controlling the pressing portion 51 of the switching element 5 to press the ball bearing 23 or be detached from the ball bearing 23.

Figure 2:
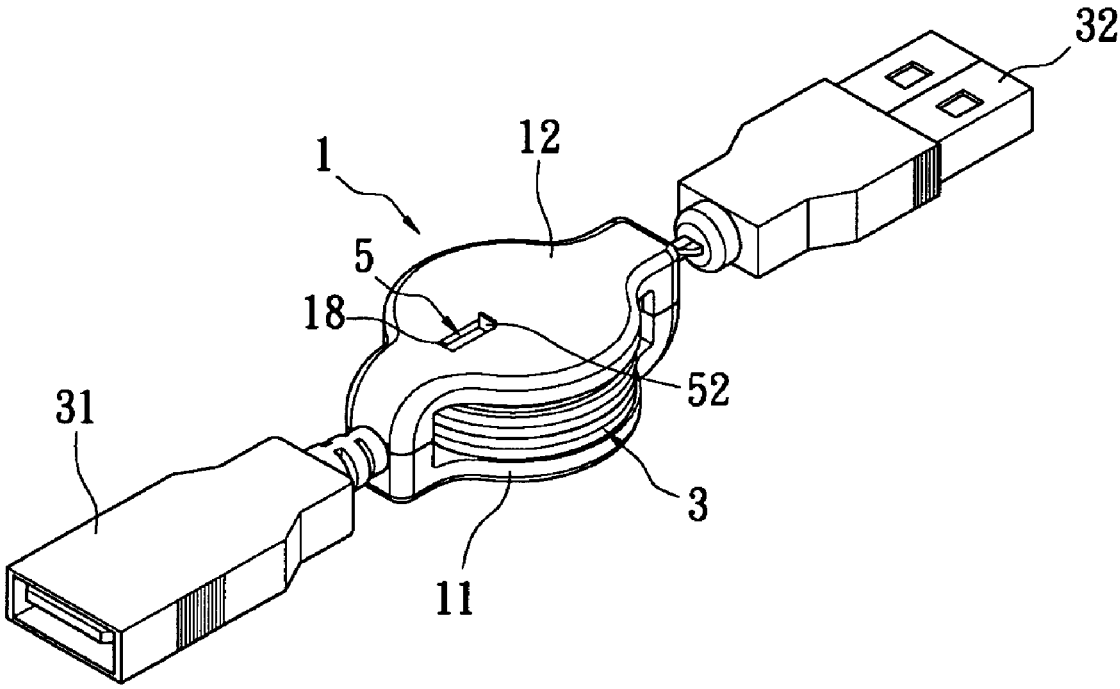
FIG. 2 is a perspective view of the first embodiment of the present invention.

Based on the above elements, the cable reel mechanism, as shown in FIG. 2, can be assembled. During actual use, since the cable reel mechanism can be used to reel up and receive a proper length of the cable 3 and retract the cable 3 at any moment, users can insert the electrical connectors 31, 32 connected by the cable 3 in sockets of related communication devices to communicate downloaded information. The two ends of the cable 3 may be pulled out of the main body 1 and may keep a certain pull-back tension force continuously under the effect of the volute spring 4 so that the cable 3 can be reeled into the main body 1 successfully, thereby preventing the cable 3 from be exposed and tangled.

Figure 4:
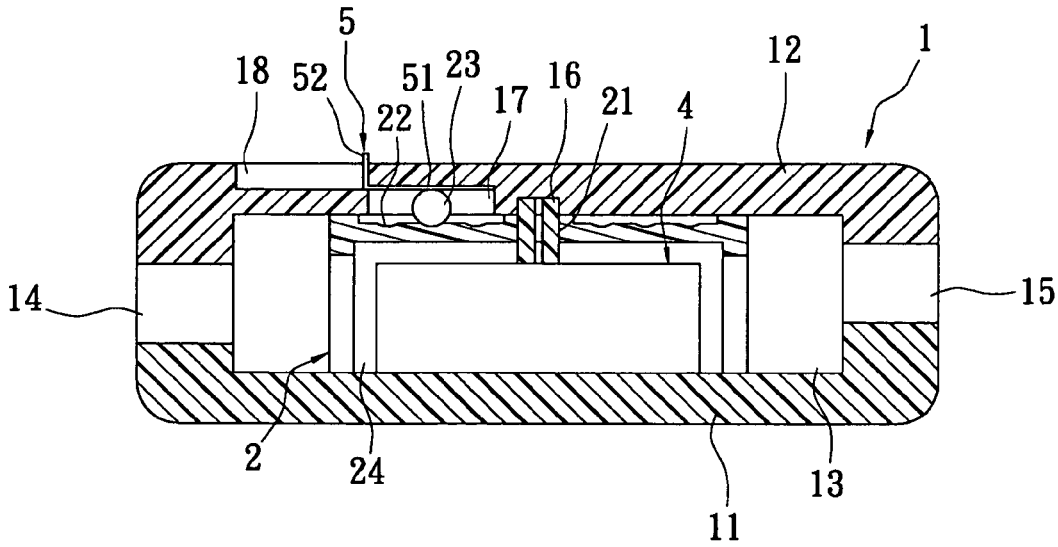
FIG. 4 is a partial cross-sectional view of the first embodiment of the present invention, in another operation state.

As shown in FIG. 4, when users push the switching element 5 to move towards the ball bearing 23, the pressing portion 51 presses the ball bearing 23, and the ball bearing 23 is pressed down to be located in the track groove 22 by the pressing portion 51. Based on the special engagement of the ball bearing 23 and the track groove 22, the cable 3 can be repeatedly pulled then retracted so that the cable 3 can become fixed or moveable, thereby users would not be troubled by the reel tension force, and they can pull a proper length of the cable 3 easily. Therein, this operation mode may be a conventional operation mode, and the cable 3 must be repeatedly pulled then retracted, thereby adjusting the length of the cable 3.

Figure 3:
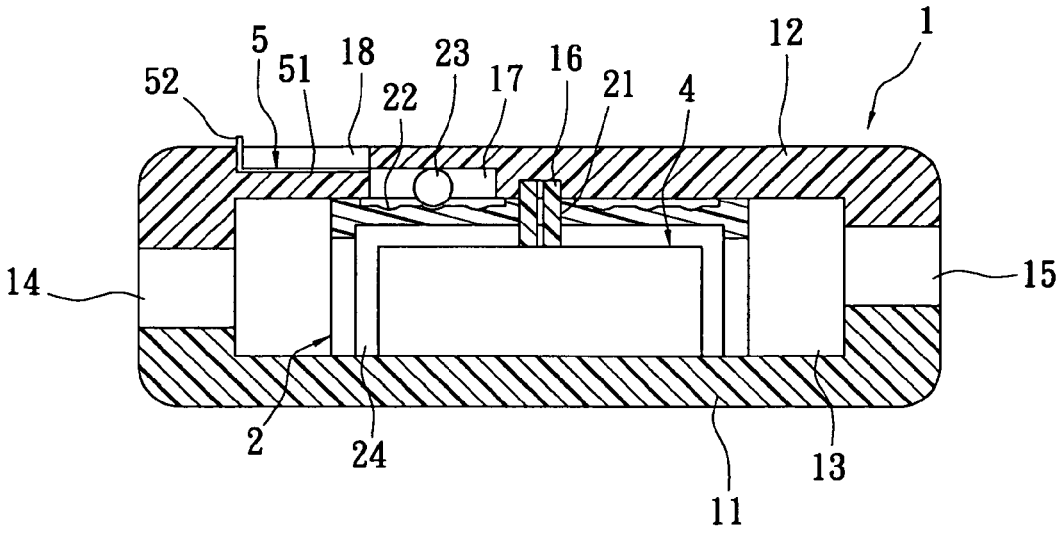
FIG. 3 is a partial cross-sectional view of the first embodiment of the present invention.

As shown in FIG. 3, when users push the switching element 5 to move away from the ball bearing 23, that is, it is switched into another operation mode, and the pressing portion 51 is detached from the ball bearing 23, so that there is a gap formed between the ball bearing 23 and the main body 1. So that the ball bearing 23 can move upwards, at this time, the ball bearing 23 is detached from the track groove 22, the ball bearing 23 and the track groove 22 cannot engage with each other, and the cable reel 2 is in a free-rotation (race rotation) state, thereby users can pull then retract the cable 3 rapidly and directly so as to adjust the length of the cable 3.

Figure 5:
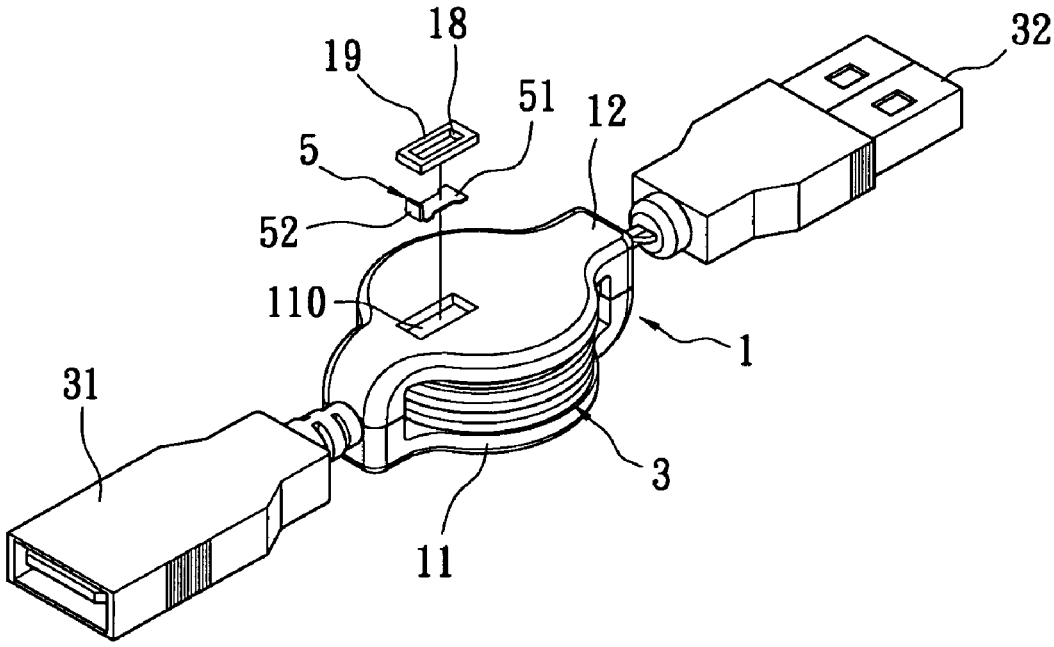
FIG. 5 is a perspective view of a second embodiment of the present invention.

Alternatively, as shown in FIG. 5, which shows a second embodiment according to the present invention, the sliding groove 18 has an assembly design, that is, the sliding groove 18 is formed in a seat body 19 which is fastened and mounted in a corresponding concave groove 110 of the main body 1 for convenient disassembly and assembling of the switching element 5.

Figure 6:
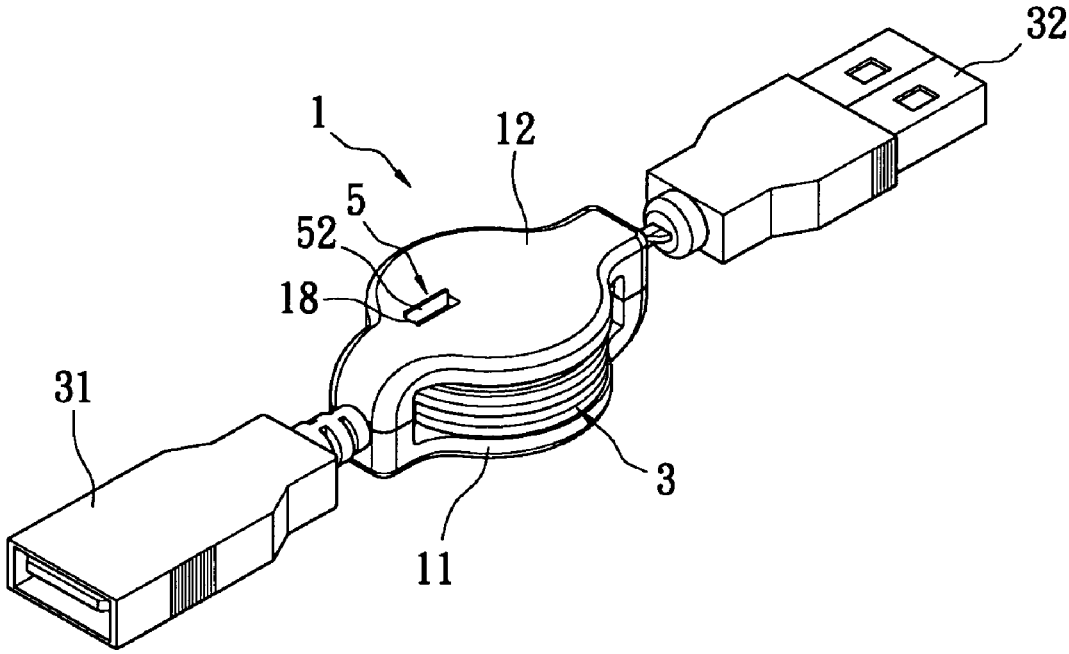
FIG. 6 is a perspective view of a third embodiment of the present invention.

Alternatively, as shown in FIG. 6, which shows a third embodiment according to the present invention, the switching element 5 may be pushed to move along a transverse straight line for controlling the pressing portion 51 of the switching element 5 to press the ball bearing 23 or be detached from the ball bearing 23.

Figure 7:
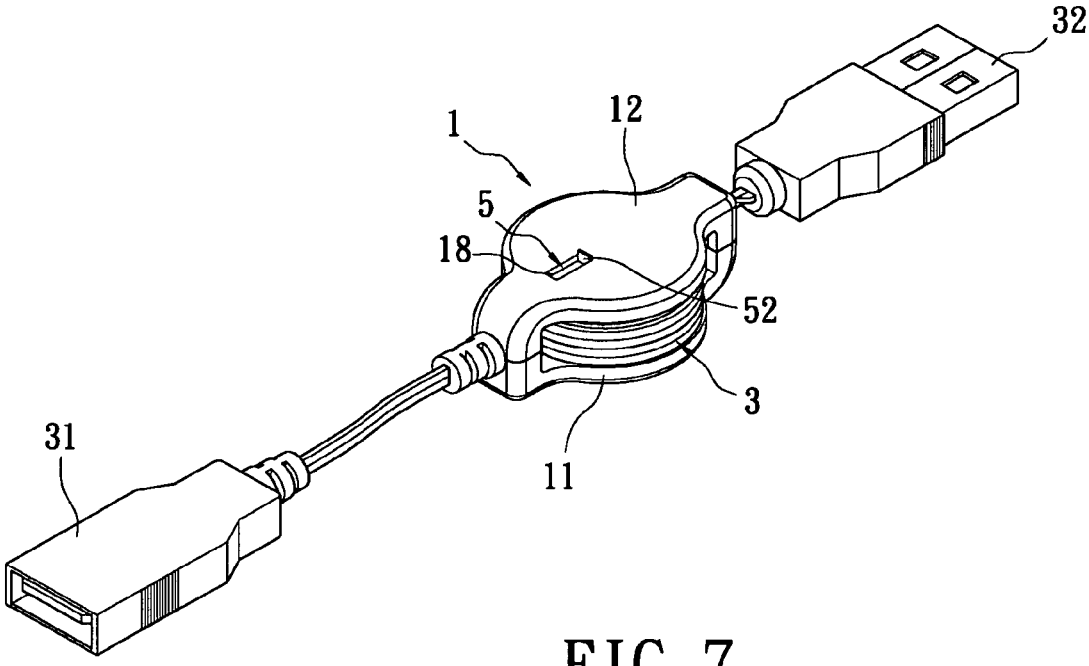
FIG. 7 is a perspective view of a fourth embodiment of the present invention.

Alternatively, as shown in FIG. 7, which shows a fourth embodiment according to the present invention, the electrical connector 31 is fixedly connected with the main body 1 and cannot be drawn or pulled. Only the electrical connector 32 connected with one end of the cable 3 can be pulled or drawn freely to form a single-pull-typed cable reel mechanism.

Figure 8:
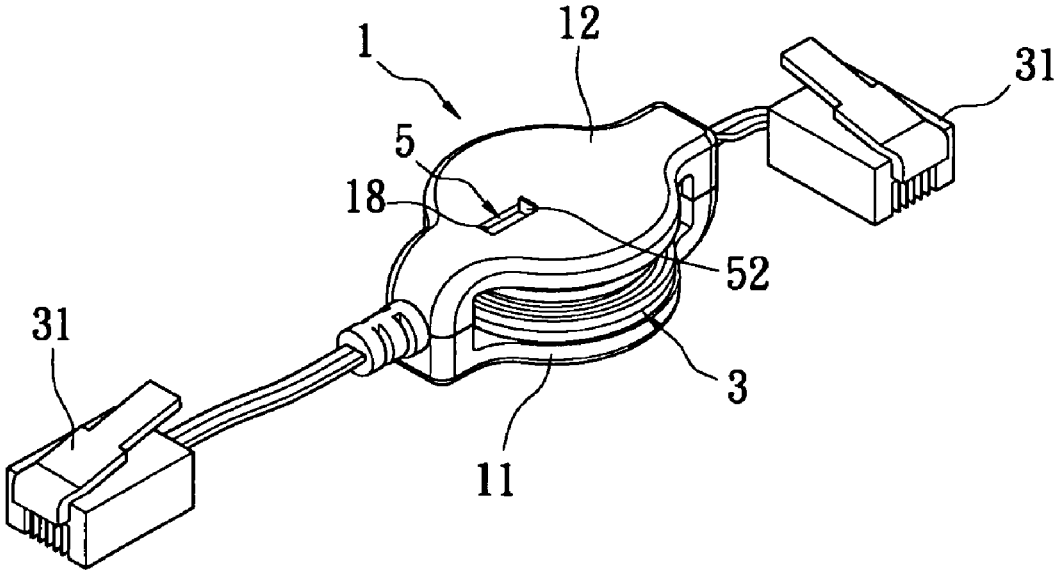
FIG. 8 is a perspective view of a fifth embodiment of the present invention.

Alternatively, as shown in FIG. 8, which shows a fifth embodiment according to the present invention, the electrical connectors 31, 32 are a kind of RJ-typed plugs.

Figure 9:
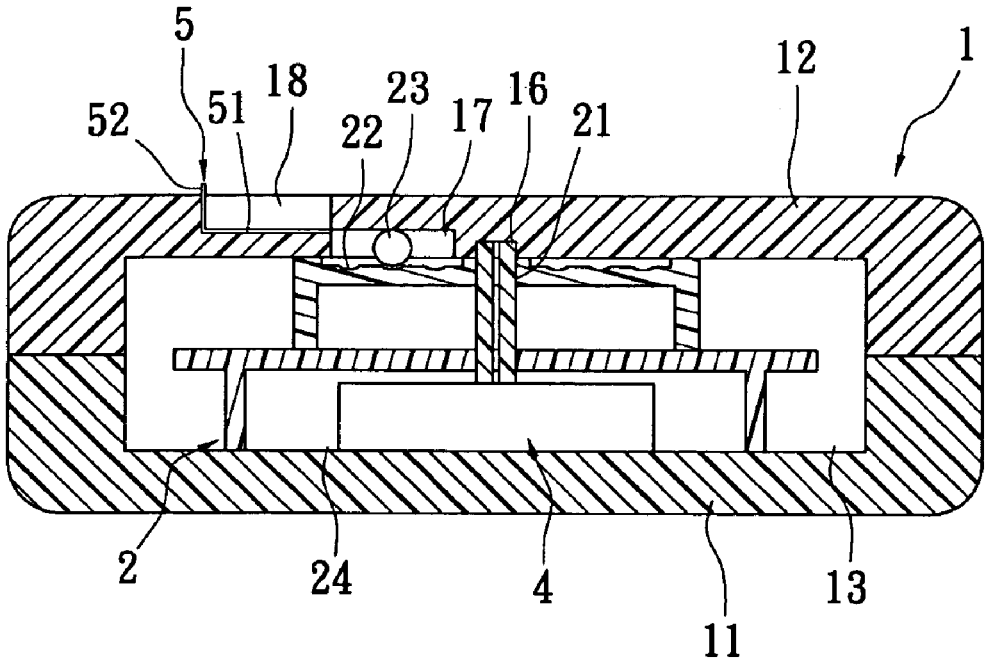
FIG. 9 is a cross-sectional view of a sixth embodiment of the present invention.
Figure 10:
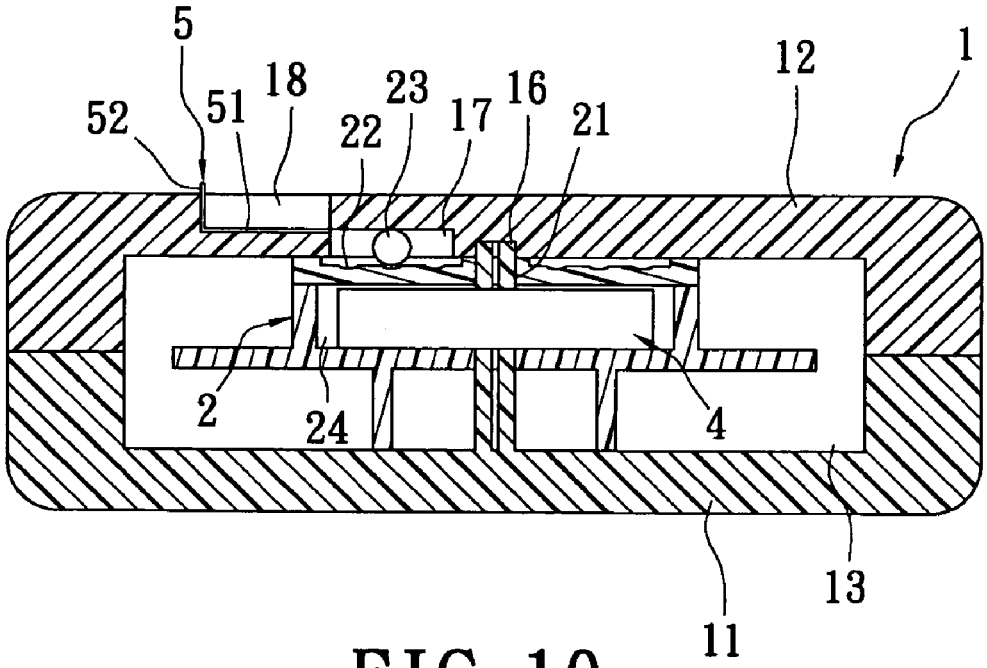
FIG. 10 is a cross-sectional view of a seventh embodiment of the present invention.

Alternatively, as shown in FIG. 9 and FIG. 10, which shows a sixth embodiment and seventh embodiment of the present invention, wherein the structures of the main body 1 and the cable reel 2 have different variations.

Figure 11:
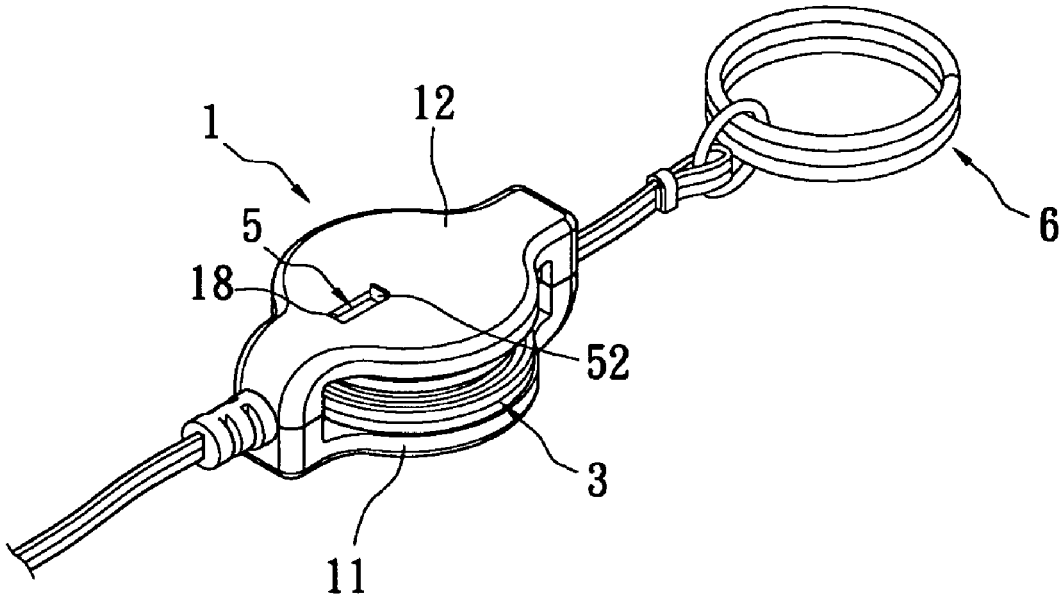
FIG. 11 is a perspective view of an eighth embodiment of the present invention.
Figure 12:
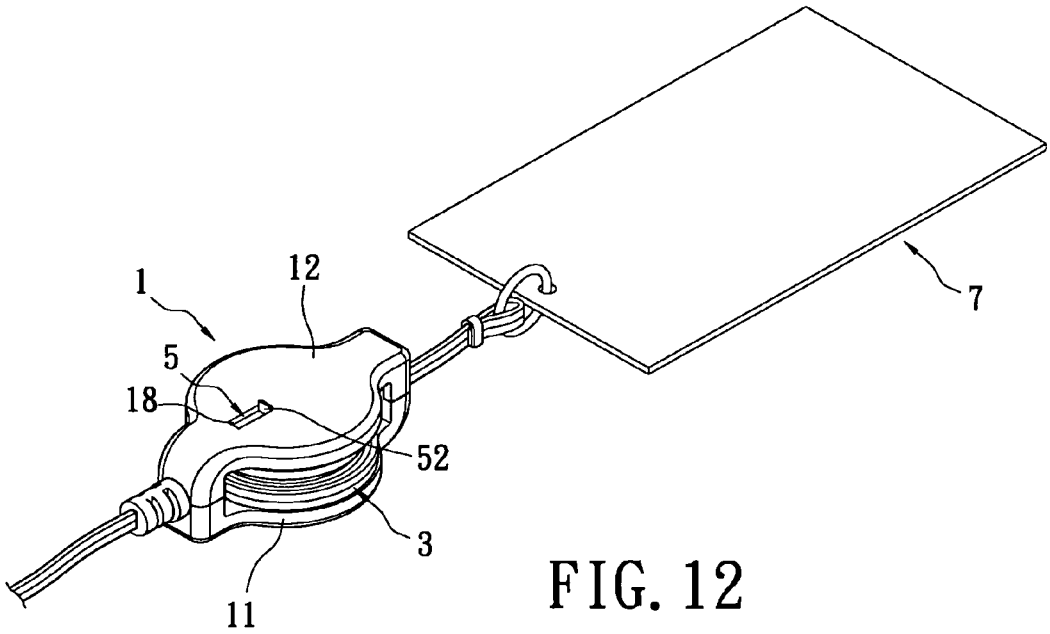
FIG. 12 is a perspective view of a ninth embodiment of the present invention.

Alternatively, as shown in FIG. 11 and FIG. 12, which shows an eighth embodiment and a ninth embodiment of the present invention, wherein one end of the cable 3 is respectively connected with a key ring 6 and an identification card 7.

Figure 13:
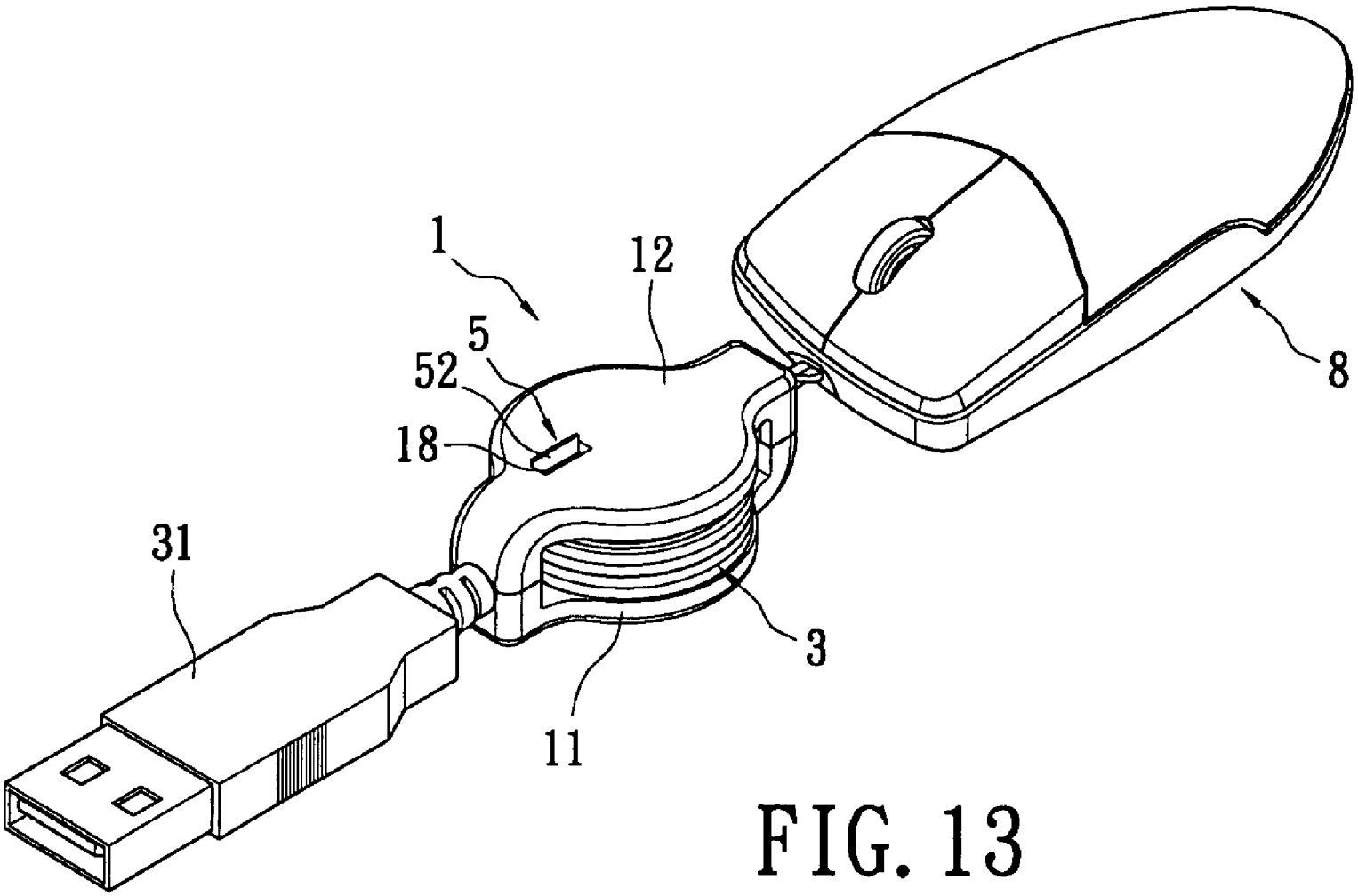
FIG. 13 is a perspective view of a tenth embodiment of the present invention.

Alternatively, as shown in FIG. 13, which shows a tenth embodiment of the present invention, wherein one end of the cable 3 is connected with a mouse 8.

The present invention can be switched in two kinds of different operation modes via the switching element 5. When users push the switching element 5 in order that the pressing portion 51 is detached from the ball bearing 23, the ball bearing 23 can be detached from the track groove 22, so the ball bearing 23 and the track groove 22 have no engagement established there-between, and the cable reel 2 is in the free-rotation state, thereby users can pull then retract the cable 3 rapidly and directly to adjust the length of the cable 3. Accordingly, the cable 3 needn't be adjusted via repeatedly pulling then retracting, and the operation is easier and more convenient.

Figure 14:
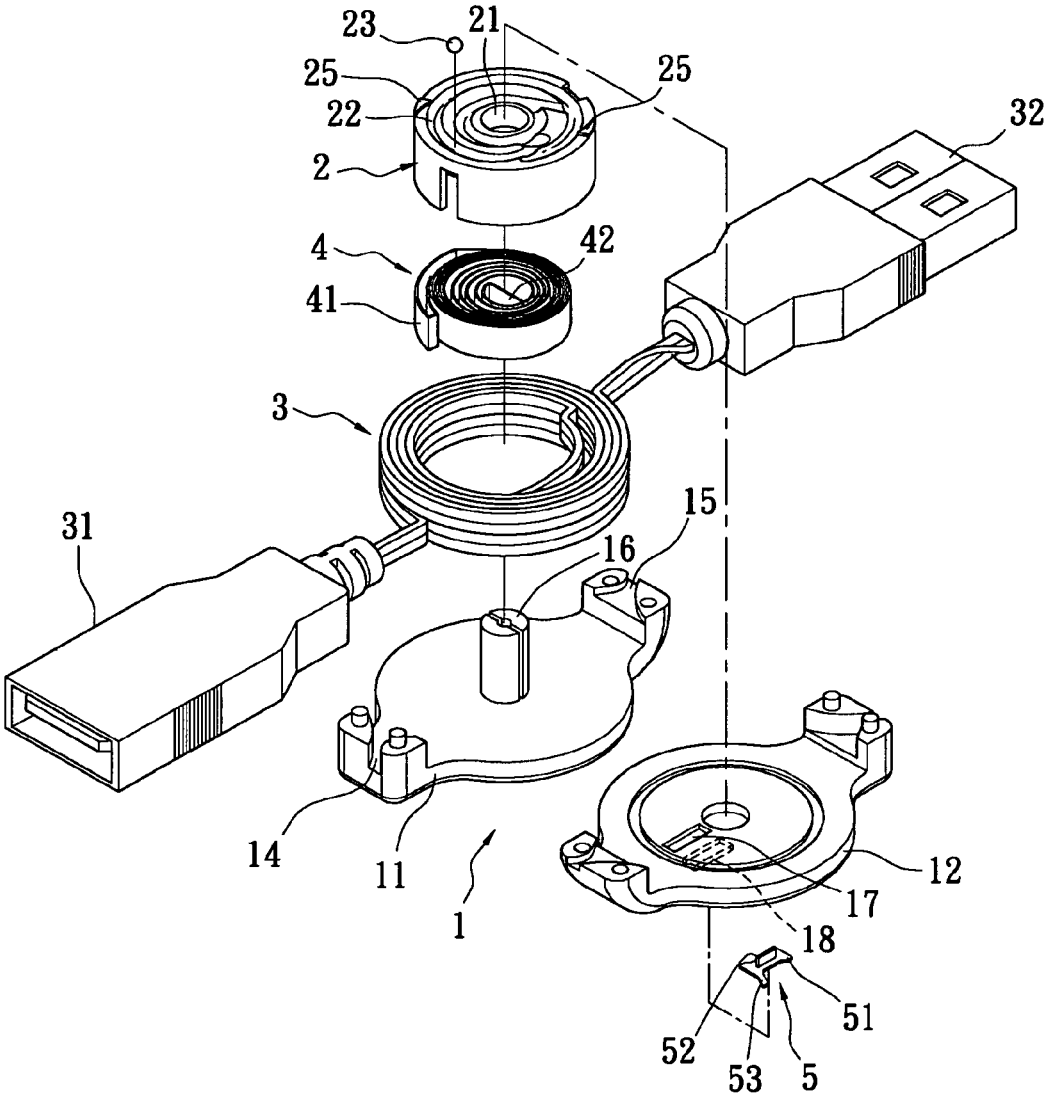
FIG. 14 is an exploded perspective view of an eleventh embodiment of the present invention.
Figure 15:
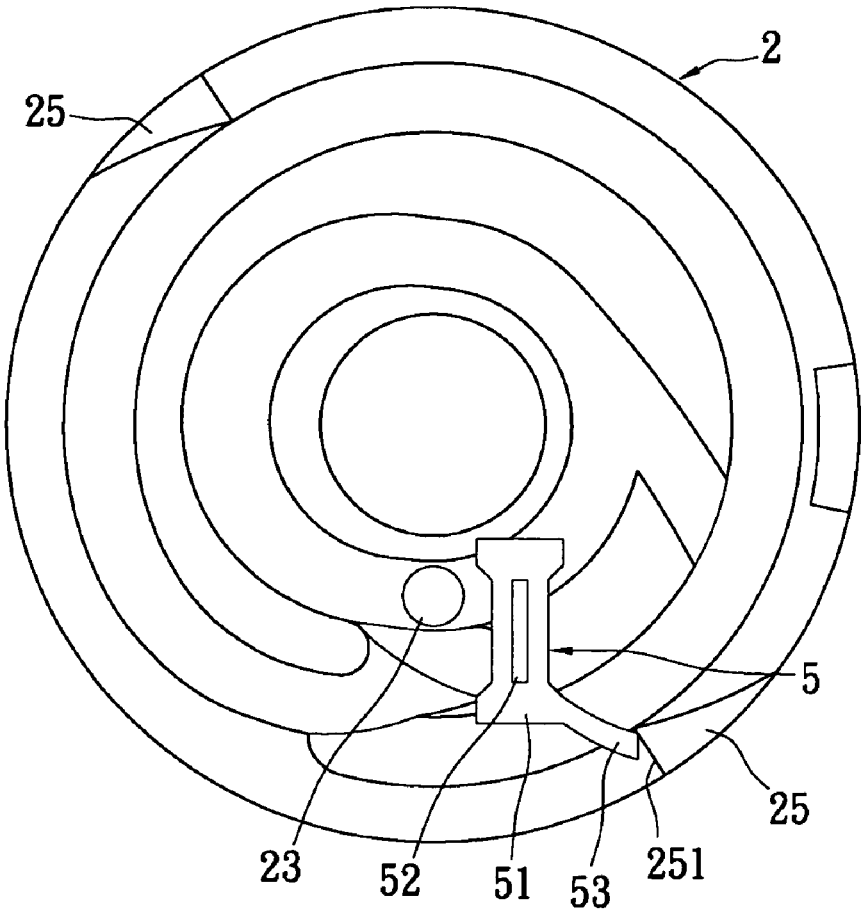
FIG. 15 is a partial top view of the eleventh embodiment of the present invention.
Figure 16:
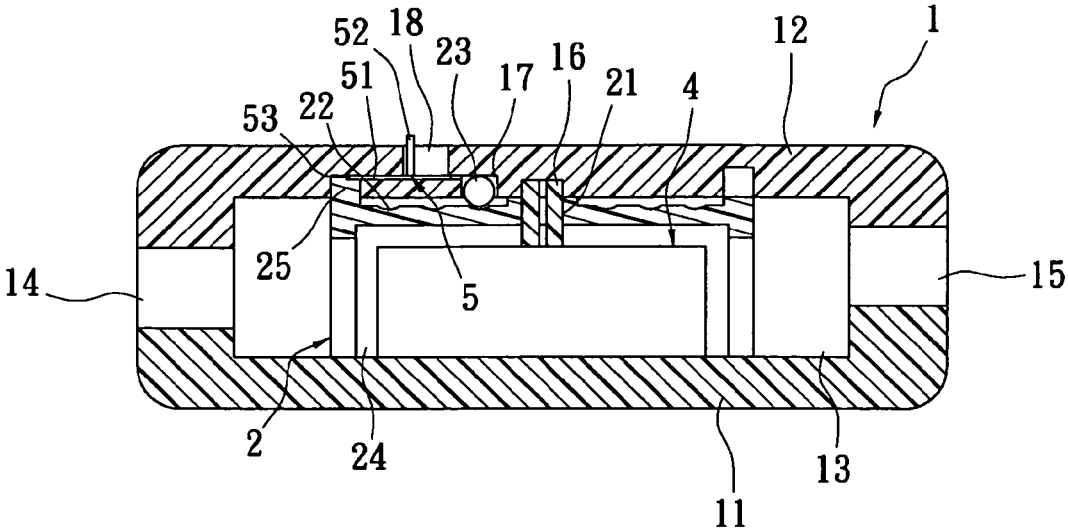
FIG. 16 is a partial exploded view of the eleventh embodiment of the present invention.

Please refer to FIGS. 14-16, which shows an eleventh embodiment of the present invention, wherein the switching element 5 further extends to form a blocking portion 53 which is connected with the other end of the pressing portion 51. At least one stopping portion 25 protrudes from the cable reel 2, corresponding to the blocking portion 53, and in the present embodiment, two stopping portions 25 are disposed on the cable reel 2. Each stopping portion 25 has a stopping surface 251. Based on the pushing of the switching element 5, the blocking portion 53 of the switching element 5 can be selectively fastened on the stopping surface 251 of the stopping portion 25 of the cable reel 2.

Figure 17:
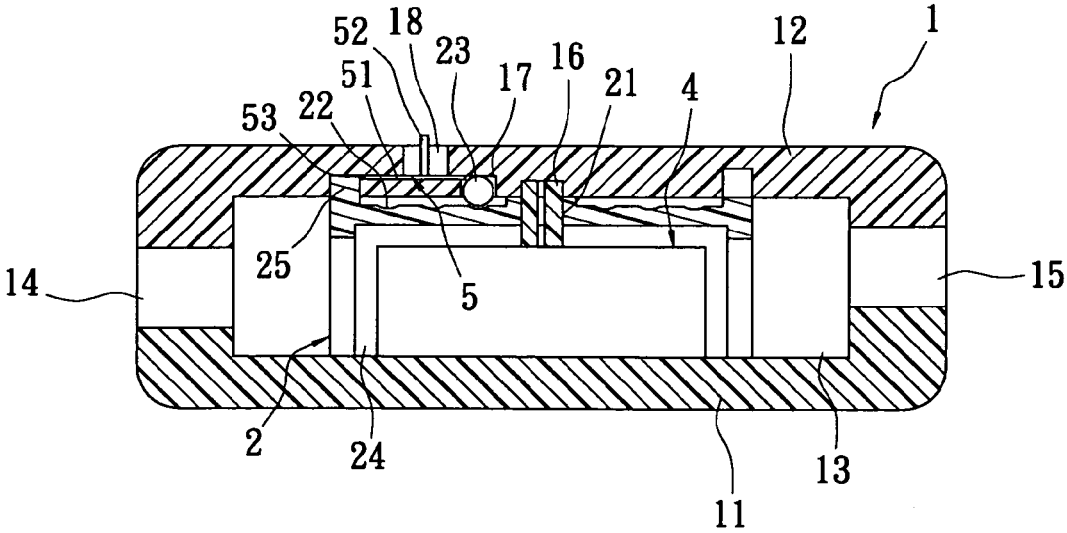
FIG. 17 is a partial cross-sectional view of the eleventh embodiment of the present invention, in another operation state.

In the present embodiment, the present invention can be switched to three kinds of operation modes via the switching element 5. When users push the switching element 5 to move towards the stopping portion 25 (as shown in FIG. 15 and FIG. 16), the blocking portion 53 of the switching element 5 can abut against the stopping surface 251 of the stopping portion 25 of the cable reel 2 to stop the cable reel 2, so that the cable 3 can be fixed and users would not be troubled by the reel tension force and can pull out a needed fixed length of the cable 3. When users push the switching element 5 so that the stopping portion 53 is detached from the stopping surface 251 of the stopping portion 25 of the cable reel 2 (as shown in FIG. 17), the cable reel 2 is in a free-rotation state, so users can pull then retract the cable 3 rapidly and directly to adjust the length of the cable 3. The present embodiment can be switched to three kinds of different operation modes via the switching element 5 so that users can choose the optimum operation mode according to different applications; thereby the present invention is convenient for use.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. A cable reel mechanism, at least comprising:

a main body, having a receiving room defined therein and a limiting groove;

a cable reel, turnably disposed in the receiving room of the main body and having a track groove in which a ball bearing is disposed, one portion of the ball bearing engaging with the limiting groove of the main body;

a cable, reeled on the cable reel;

a volute spring, connected between the cable reel and the main body; and a switching element, disposed on the main body and having a pressing portion, said pressing portion being displaceable within said limiting groove for frictional engagement with the ball bearing to press the ball bearing to the track groove.

2. The cable reel mechanism as claimed in claim 1, wherein the main body includes a first shell and a second shell which are assembled to form one part, and a first cable hole and a second cable hole are formed at the side edges of the main body, and two ends of the cable respectively extend out from the first cable hole and the second cable of the main body.

3. The cable reel mechanism as claimed in claim 1, wherein a protruding shaft is disposed on an inner wall of the main body, the cable reel has a shaft hole formed in a center thereof, and the cable reel is pivotedly disposed on the protruding shaft based on the shaft hole.

4. The cable reel mechanism as claimed in claim 1, wherein the main body has a sliding groove, and the switching element is slidably disposed in the sliding groove.

5. The cable reel mechanism as claimed in claim 4, wherein the sliding groove is formed in a seat body which is mounted on the main body.

6. The cable reel mechanism as claimed in claim 1, wherein the main body has a receiving groove in which the volute spring is disposed, a first fastening end and a second fastening end are respectively formed on two ends of the volute spring and respectively fastened in the cable reel and the main body.

7. The cable reel mechanism as claimed in claim 1, wherein the track groove is disposed in one face of the cable reel.

8. The cable reel mechanism as claimed in claim 1, wherein two ends of the cable are respectively connected with electrical connectors.

9. The cable reel mechanism as claimed in claim 1, wherein the switching element has a pushing portion connected with the pressing portion and extending out of the main body.

10. The cable reel mechanism as claimed in claim 1, wherein the pressing portion of the switching element extends into the limiting groove of the main body.

11. The cable reel mechanism as claimed in claim 1, wherein the switching element extends to form a blocking portion, the cable reel has at least one stopping portion, and the blocking portion of the switching element is selectively fastened on the stopping portion of the cable reel.

12. The cable reel mechanism as claimed in claim 11, wherein the blocking portion is connected with the pressing portion.

13. The cable reel mechanism as claimed in claim 11, wherein the stopping portion has a stopping surface, and the blocking portion of the switching element is selectively fastened on the stopping surface of the stopping portion.

* * * * *